US008875473B1

(12) United States Patent
Frombach

(10) Patent No.: US 8,875,473 B1
(45) Date of Patent: Nov. 4, 2014

(54) GUTTER INSTALLATION ASSEMBLY

(71) Applicant: Richard K. Frombach, Hoquiam, WA (US)

(72) Inventor: Richard K. Frombach, Hoquiam, WA (US)

( * ) Notice: Subject to any disclaimer, the term of this patent is extended or adjusted under 35 U.S.C. 154(b) by 0 days.

(21) Appl. No.: 14/085,196

(22) Filed: Nov. 20, 2013

(51) Int. Cl.
*E04D 15/00* (2006.01)
*E04F 21/00* (2006.01)
*E04G 21/14* (2006.01)

(52) U.S. Cl.
CPC ..... *E04F 21/00* (2013.01); *Y10S 52/01* (2013.01); *Y10S 52/04* (2013.01); *Y10S 269/902* (2013.01)
USPC ... 52/749.1; 52/127.1; 52/DIG. 1; 52/DIG. 4; 81/125; 269/3; 269/902; 29/278

(58) Field of Classification Search
CPC ..... E04G 21/16; E04D 15/00; B25C 1/02; B25C 3/008; Y10S 52/01; Y10S 52/04
USPC ..... 52/127.1, 127.5–127.7, 749.1, DIG. 1, 52/DIG. 4; 81/44, 13, 125, 462; 269/3, 6, 269/95, 902, 143, 249; 29/270, 244, 278
See application file for complete search history.

(56) References Cited

U.S. PATENT DOCUMENTS

| | | | | |
|---|---|---|---|---|
| 3,909,905 | A | 10/1975 | Giordano | |
| 4,564,182 | A | 1/1986 | Svajgl | |
| 4,733,812 | A | 3/1988 | Lewis et al. | |
| 4,834,352 | A * | 5/1989 | Thornton | 269/6 |
| 4,874,123 | A | 10/1989 | Mercer, II et al. | |
| 5,007,224 | A | 4/1991 | Segneri | |
| 5,240,234 | A | 8/1993 | Lee | |
| D372,178 | S | 7/1996 | Gossett et al. | |
| 5,768,830 | A * | 6/1998 | Kelly | 52/127.1 |
| 5,873,568 | A | 2/1999 | Mayfield | |
| 2011/0265423 | A1 * | 11/2011 | Richmond | 52/749.1 |

FOREIGN PATENT DOCUMENTS

WO WO2013041706 3/2013

* cited by examiner

*Primary Examiner* — Brian Glessner
*Assistant Examiner* — Brian D Mattei

(57) ABSTRACT

A gutter installation assembly for holding a gutter, a ferrule and a fastener proximate a roof edge includes a holder that may be positioned proximate the roof edge. A vertical portion of the holder may be gripped by a user. A U-shaped portion of the holder is coupled to the vertical portion of the holder. The U-shaped portion of the holder may position the ferrule and the fastener proximate the roof edge. A retainer is coupled to the U-shaped portion of the holder. The retainer may retain the fastener on the U-shaped portion of the holder. A horizontal portion of the holder is coupled to the vertical portion of the holder. The horizontal portion of the holder may support the gutter. The user drives the fastener into the roof edge so the fastener retains the gutter on the roof edge.

18 Claims, 4 Drawing Sheets

GUTTER INSTALLATION ASSEMBLY

BACKGROUND OF THE DISCLOSURE

Field of the Disclosure

The disclosure relates to gutter installation devices and more particularly pertains to a new gutter installation device for a gutter, a ferrule and a fastener proximate a roof edge.

SUMMARY OF THE DISCLOSURE

An embodiment of the disclosure meets the needs presented above by generally comprising a holder that may be positioned proximate the roof edge. A vertical portion of the holder may be gripped by a user. A U-shaped portion of the holder is coupled to the vertical portion of the holder. The U-shaped portion of the holder may position the ferrule and the fastener proximate the roof edge. A retainer is coupled to the U-shaped portion of the holder. The retainer may retain the fastener on the U-shaped portion of the holder. A horizontal portion of the holder is coupled to the vertical portion of the holder. The horizontal portion of the holder may support the gutter. The user drives the fastener into the roof edge so the fastener retains the gutter on the roof edge.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
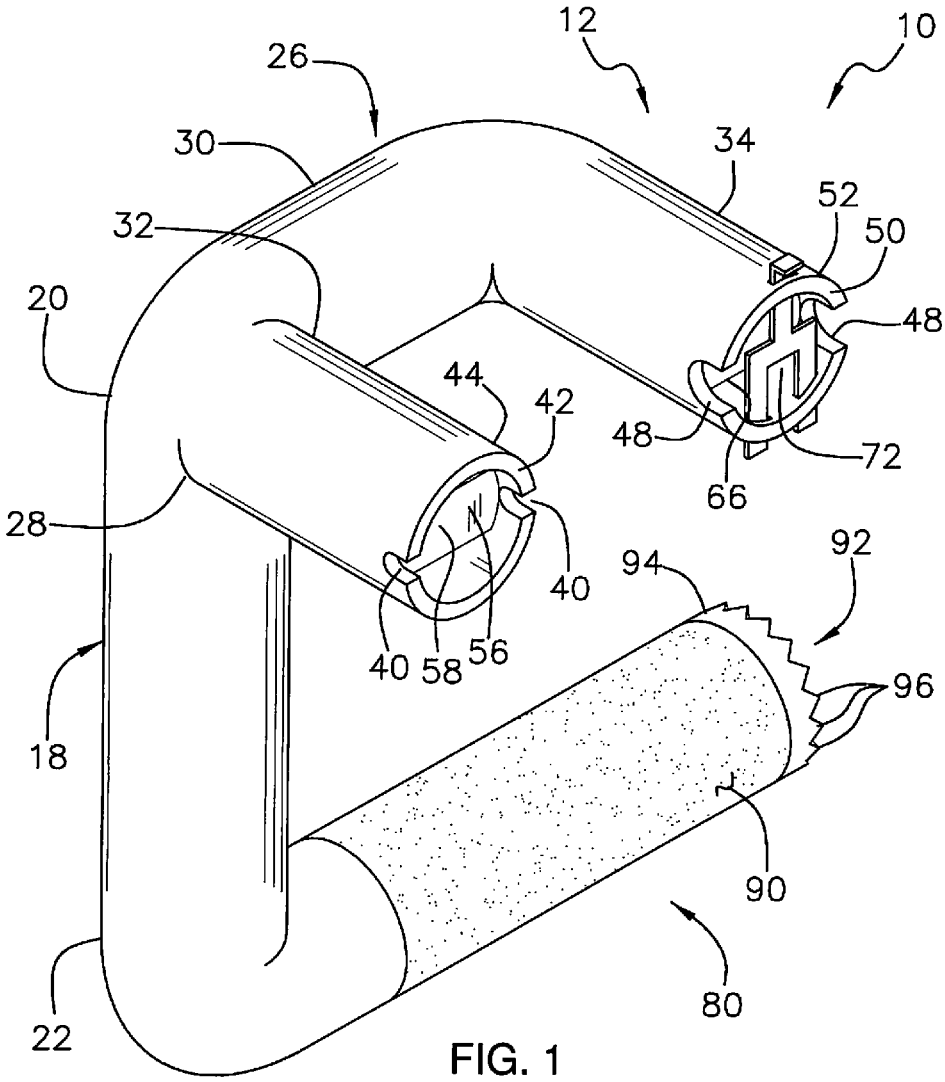
FIG. 1 is a perspective view of a gutter installation assembly according to an embodiment of the disclosure.
Figure 2:
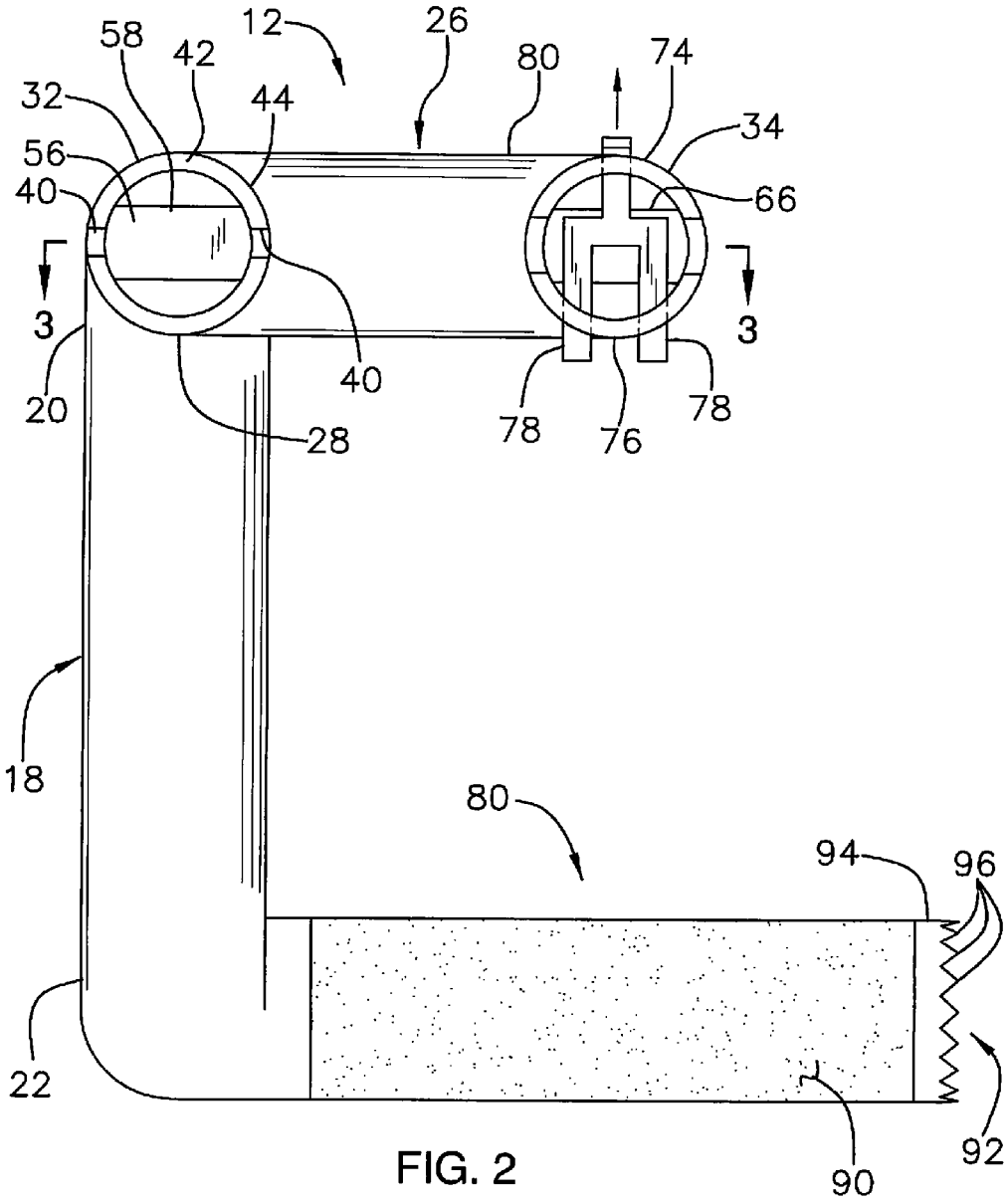
FIG. 2 is a right side view of an embodiment of the disclosure.
Figure 3:
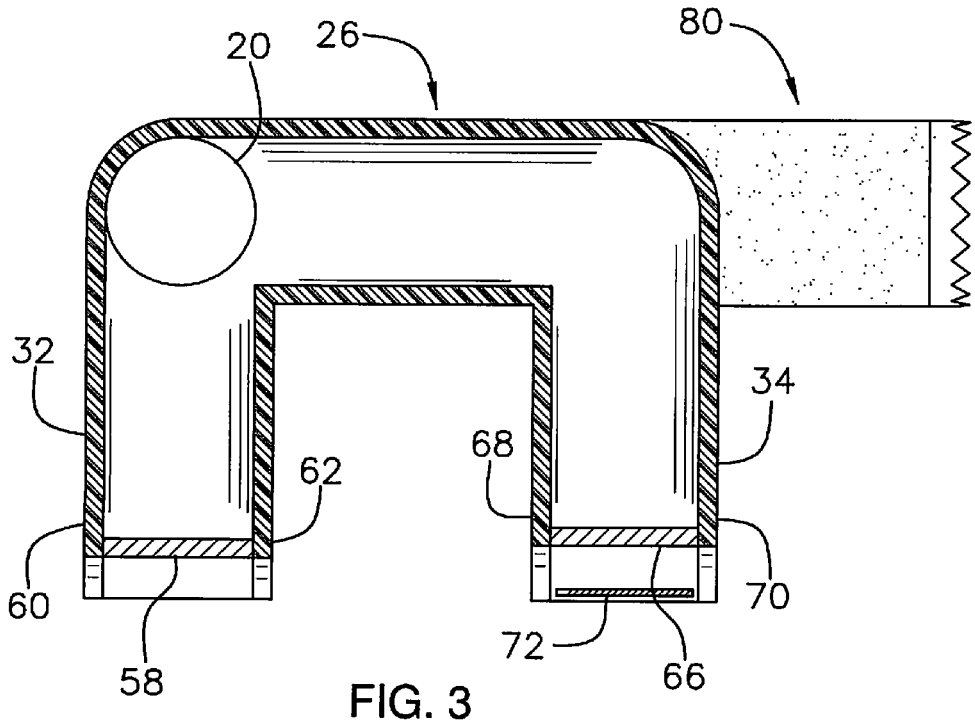
FIG. 3 is a cross sectional view taken along line 3-3 of FIG. 2 of an embodiment of the disclosure.
Figure 4:
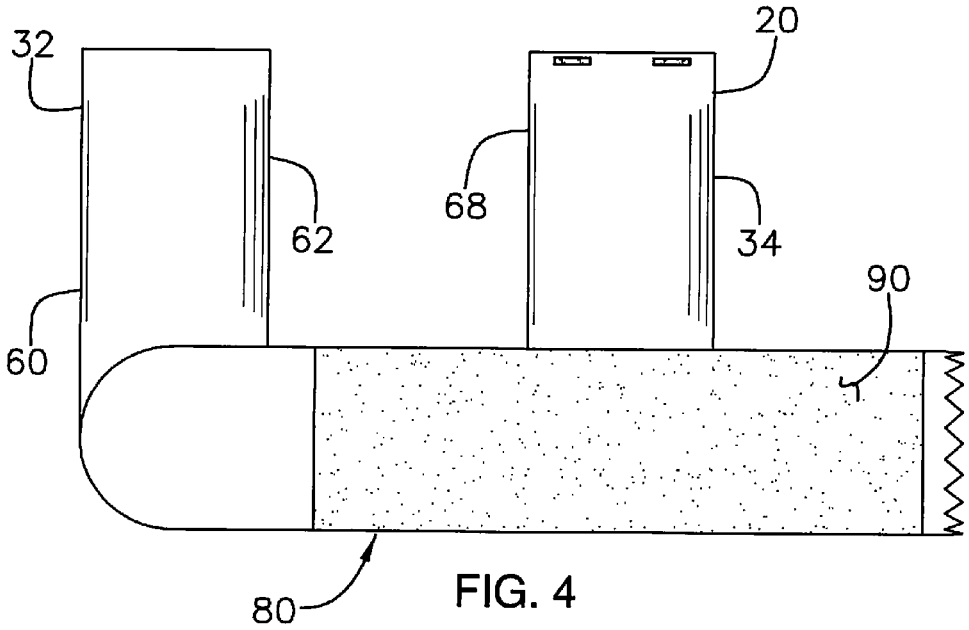
FIG. 4 is a bottom view of an embodiment of the disclosure.
Figure 5:
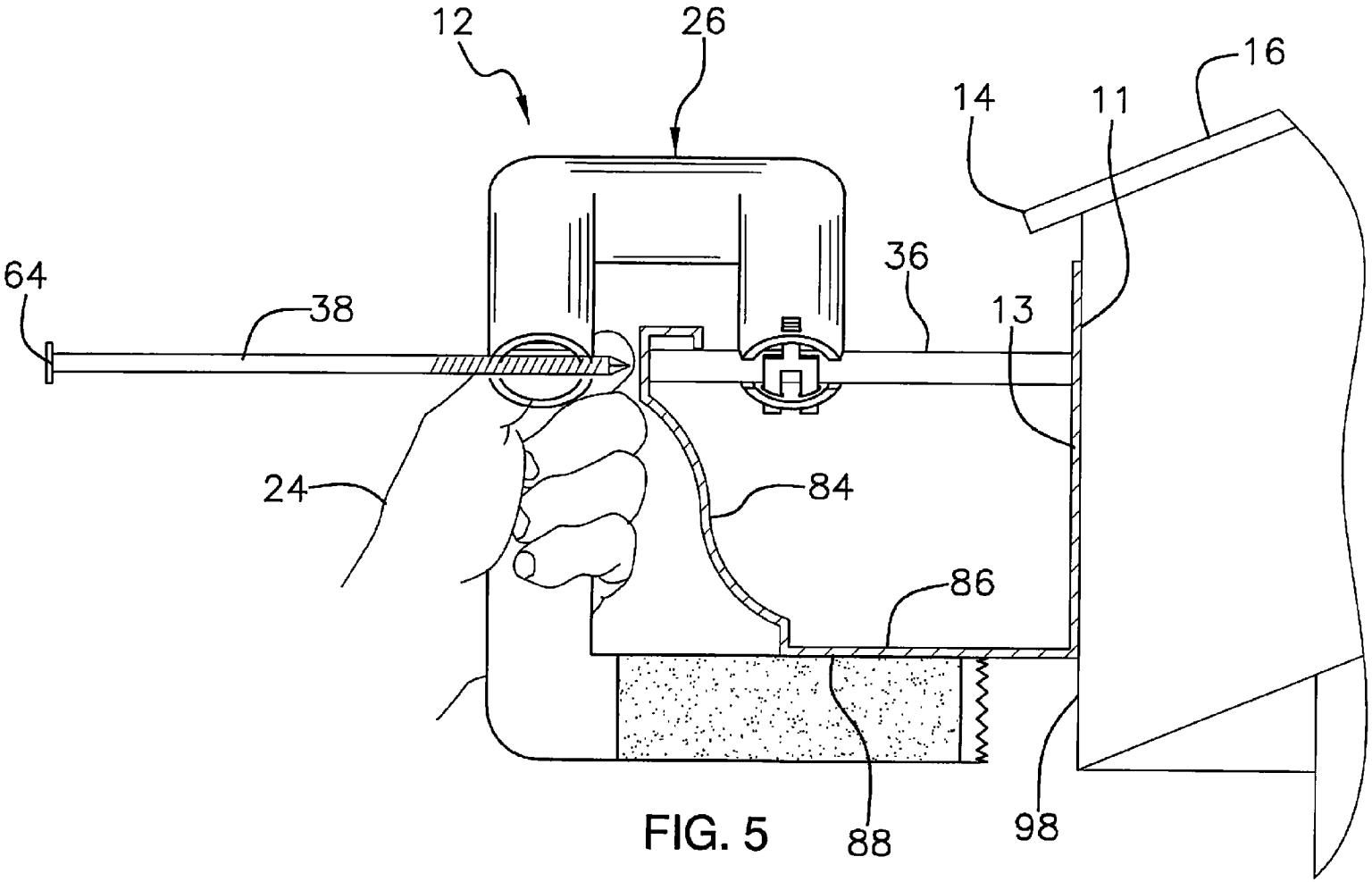
FIG. 5 is an in-use view of an embodiment of the disclosure.

With reference now to the drawings, and in particular to FIGS. 1 through 5 thereof, a new gutter installation device embodying the principles and concepts of an embodiment of the disclosure and generally designated by the reference numeral 10 will be described.

As best illustrated in FIGS. 1 through 5, the gutter installation assembly 10 generally comprises a holder 12 that may be positioned proximate a roof edge 14 of a roof 16. The roof 16 may be a building roof of any conventional design. Continuing, a vertical portion 18 of the holder 12 is elongated along a longitudinal axis extending through a top end 20 and a bottom end 22 of the vertical portion 18 of the holder 12. The vertical portion 18 of the holder 12 may be gripped by a user 24. Additionally, the vertical portion 18 of the holder 12 may have a length between 12 cm and 18 cm.

A U-shaped portion 26 of the holder 12 is coupled to the top end 20 of the vertical portion 18 of the holder 12. The top end 20 of the vertical portion 18 of the holder 12 is positioned on a bottom side 28 of the U-shaped portion 26 of the holder 12. Moreover, the top end 20 of the vertical portion 18 of the holder 12 is positioned proximate an intersection of a middle portion 30 and a first lateral portion 32 of the U-shaped portion 26 of the holder 12. The middle portion 30 of the U-shaped portion 26 of the holder 12 may have a length between 10 cm and 13 cm. Further, the first lateral 32 and a second lateral 34 portion of the U-shaped portion 26 of the holder 12 may each have a length between 7 cm and 10 cm. The U-shaped portion 26 of the holder 12 extends laterally away from the vertical portion 18 of the holder 12. Continuing, the U-shaped portion 26 of the holder 12 may position a ferrule 36 and a fastener 38 proximate the roof edge 14.

A first pair of grooves 40 extends inwardly from opposite sides of a leading edge 42 of an open end 44 of a first lateral portion 32 of the U-shaped portion 26 of the holder 12. The first pair of grooves 40 may insertably receive the fastener 38. Moreover, the fastener 38 may be a nail of any conventional design. A second pair of grooves 48 extends inwardly from opposite sides of a leading edge 50 of an open end 52 of the second lateral portion 34 of the U-shaped portion 26 of the holder 12. The second pair of grooves 48 may insertably receive the ferrule 36. The ferrule 36 may be a gutter ferrule of any conventional design.

A retainer 56 is coupled to the U-shaped portion 26 of the holder 12. Continuing, the retainer 56 may retain the fastener 38 on the U-shaped portion 26 of the holder 12. The retainer 56 may be comprised of a magnetic material. Moreover, the retainer 56 is one of a pair of the retainers 56.

A first one of the pair of retainers 58 is coupled to the U-shaped portion 26 of the holder 12. The first retainer 58 is positioned within the first lateral portion 32 of the U-shaped portion 26 of the holder 12 proximate the open end 44 of the first lateral portion 32 of the U-shaped portion 26 of the holder 12. Moreover, the first retainer 58 extends between each of a first lateral side 60 and a second lateral side 62 of the first lateral portion 34 of the U-shaped portion 26 of the holder 12. Continuing, the first retainer 58 magnetically engages the fastener 38 so the fastener 38 is retained in the first pair of grooves 40. A head 64 of the fastener 38 is spaced away from the first lateral arm 46 of the U-shaped portion 26 of the holder 12 when the fastener 38 is positioned within the first pair of grooves 40.

A second one of the pair of retainers 66 is coupled to the U-shaped portion 26 of the holder 12. The second retainer 66 is positioned within the second lateral arm 54 of the U-shaped portion 26 of the holder proximate the open end 52 of the second lateral arm 54 of the U-shaped portion 26 of the holder 12. Continuing, the second retainer 66 extends between a first lateral side 68 and a second lateral side 70 of the second lateral arm 54 of the U-shaped portion 26 of the holder 12. The second retainer 66 magnetically engages the ferrule 36 so the ferrule 36 is retained in the pair of second grooves 48 if the ferrule 36 is comprised of a magnetic material.

A fork 72 is movably coupled to the second lateral arm 54 of the U-shaped portion 26 of the holder 12 proximate the leading edge 50 of the open end 52 of the second lateral arm 54 of the U-shaped portion 26 of the holder 12. The fork 72 extends through a top side 74 and a bottom side 76 of the second lateral arm 54 of the U-shaped portion 26 of the holder 12. Moreover, the fork 72 is positionable in a retaining position so a pair of vertical arms 78 of the fork 72 extends downwardly through the bottom side 76 of the second lateral arm 54 of the U-shaped portion 26 of the holder 12. The fork 72 selectively retains the ferrule 36 in the pair of second grooves 48 if the ferrule 36 is comprised of a non-magnetic material. Continuing, the fork 72 is positionable in a releasing position so the pair of vertical arms 78 of the fork 72 are spaced upwardly away from the bottom side 76 of the second lateral arm 54 of the U-shaped portion 26 of the holder 12. The ferrule 36 is removable from the pair of second grooves 48 when the fork 72 is in the releasing position.

A horizontal portion 80 of the holder 12 extends forwardly away from the bottom end 22 of the vertical portion 18 of the holder 12. The horizontal portion 80 of the holder 12 may have a length between 10 cm and 15 cm. Continuing, the horizontal portion 80 of the holder 12 is positionable below a gutter 84. A top 86 of the horizontal portion 80 of the holder 12 abuts a bottom side 88 of the gutter 84 so the horizontal portion 80 of the holder 12 may to support the gutter 84.

An outside surface 90 of the horizontal portion 80 of the holder 12 is textured so the horizontal portion 80 of the holder 12 frictionally engages the bottom side 88 of the gutter 84. The gutter 84 may be a roof gutter of any conventional design. Continuing, the user 24 drives the fastener 38 into the roof edge 14 so the fastener 38 retains the gutter 84 on the roof edge 14. A leading edge 92 of an open end 94 of the horizontal portion 80 of the holder 12 comprises a plurality of teeth 96. The plurality of teeth 96 selectively engages a facia 98 on the roof edge 14 so the holder 12 is retained on the facia 98.

In use, the user 24 positions the holder 12 so the horizontal portion 80 of the holder 12 is beneath the gutter 84 and the U-shaped portion 26 of the holder 12 is above the gutter 84. Continuing, the user 24 manipulates the holder 12 so a back side 11 of the gutter 84 abuts a front side 13 of the facia 98. The user 24 positions the fastener 38 in the first pair of grooves 40 and the user 24 places the ferrule 36 in the second pair of grooves 48. Additionally, the user 24 uses the fork 72 to retain the ferrule 36 in the second pair of grooves 48 if the ferrule 36 is comprised of a non-magnetic material. The user 24 drives the fastener 38 through the ferrule 36 so the fastener 38 engages the facia 98. Lastly, the user 24 repeats the process as often as is necessary to fasten the gutter 84 to the facia 98.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A gutter installation assembly for holding a gutter, a ferrule and a fastener proximate a roof edge, said assembly comprising:

a holder configured to be positioned proximate the roof edge, said holder comprising;

a vertical portion of said holder being configured to be gripped by a user;

a U-shaped portion of said holder coupled to said vertical portion of said holder wherein said U-shaped portion of said holder is configured to position the ferrule and the fastener proximate the roof edge;

a retainer coupled to said U-shaped portion of said holder wherein said retainer is configured to retain the fastener on said U-shaped portion of said holder;

a horizontal portion of said holder coupled to said vertical portion of said holder wherein said horizontal portion of said holder is configured to support the gutter when the user drives the fastener into the roof edge wherein the fastener retains the gutter on the roof edge; and a first pair of grooves extending inwardly from opposite sides of a leading edge of an open end of a first lateral arm of said U-shaped portion of said holder wherein said first pair of grooves is configured to insertably receive the fastener.

2. The assembly according to claim 1 further comprising said vertical portion of said holder being elongated along a longitudinal axis extending through a top end and a bottom end of said vertical portion of said holder.

3. The assembly according to claim 1 further comprising said U-shaped portion of said holder being coupled to a top end of said vertical portion of said holder wherein said top end of said vertical portion of said holder is positioned on a bottom side of said U-shaped holder proximate an intersection of a middle portion and a first lateral portion of said U-shaped portion of said holder wherein said U-shaped portion of said holder extends laterally away from said vertical portion of said holder.

4. The assembly according to claim 1 further comprising a second pair of grooves extending inwardly from opposite sides of a leading edge of an open end of a second lateral arm of said U-shaped portion of said holder wherein said second pair of grooves is configured to insertably receive the ferrule.

5. The assembly according to claim 1 further comprising said retainer being one of a pair of said retainers.

6. The assembly according to claim 5 further comprising a first one of said pair of retainers being coupled to said U-shaped portion of said holder wherein said first retainer is positioned within a first lateral arm of said U-shaped portion of said holder proximate an open end of said first lateral arm of said U-shaped portion of said holder.

7. The assembly according to claim 6 further comprising said first retainer engaging the fastener when the fastener is retained in a first pair of grooves.

8. The assembly according to claim 5 further comprising a second one of said pair of retainers being coupled to said U-shaped portion of said holder wherein said second retainer is positioned within a second lateral arm of said U-shaped portion of said holder proximate an open end of said second lateral arm of said U-shaped portion of said holder.

9. The assembly according to claim 8 further comprising said second retainer engaging the ferrule when the ferrule is retained in a pair of second grooves.

10. The assembly according to claim 1 further comprising a fork movably coupled to a second lateral arm of said U-shaped portion of said holder proximate a leading edge of an open end of said second lateral arm of said U-shaped portion of said holder wherein said fork extends through a top side and a bottom side of said second lateral arm of said U-shaped portion of said holder.

11. The assembly according to claim 10 further comprising said fork being positionable in a retaining position wherein a pair of vertical arms of said fork extends downwardly through said bottom side of said second lateral arm of said U-shaped portion of said holder wherein said fork selectively retains the ferrule in a pair of second grooves.

12. The assembly according to claim 1 further comprising said horizontal portion of said holder extending forwardly away from a bottom end of said vertical portion of said holder.

13. The assembly according to claim 1 further comprising said horizontal portion of said holder being positioned below the gutter wherein a top of said horizontal portion of said holder abuts a bottom side of the gutter.

14. The assembly according to claim 1 further comprising a leading edge of an open end of said horizontal portion of said holder comprising a plurality of teeth.

15. The assembly according to claim 14 further comprising said plurality of teeth selectively engaging a facia on the roof edge wherein said holder is retained on the roof edge.

16. A gutter installation assembly for holding a gutter, a ferrule and a fastener proximate a roof edge, said assembly comprising:

a holder configured to be positioned proximate the roof edge, said holder comprising;

a vertical portion of said holder being elongated along a longitudinal axis extending through a top end and a bottom end of said vertical portion of said holder wherein said vertical portion of said holder is configured to be gripped by a user;

a U-shaped portion of said holder being coupled to said top end of said vertical portion of said holder wherein said top end of said vertical portion of said holder is positioned on a bottom side of said U-shaped portion of said holder proximate an intersection of a middle portion and a first lateral portion of said U-shaped portion of said holder wherein said U-shaped portion of said holder extends laterally away from said vertical portion of said holder wherein said U-shaped portion of said holder is configured to position the ferrule and the fastener proximate the roof edge;

a first pair of grooves extending inwardly from opposite sides of a leading edge of an open end of a first lateral arm of said U-shaped portion of said holder wherein said first pair of grooves is configured to insertably receive the fastener;

a second pair of grooves extending inwardly from opposite sides of a leading edge of an open end of a second lateral arm of said U-shaped portion of said holder wherein said second pair of grooves is configured to insertably receive the ferrule;

a retainer coupled to said U-shaped portion of said holder wherein said retainer is configured to retain the fastener on said U-shaped portion of said holder, said retainer being one of a pair of said retainers;

a first one of said pair of retainers being coupled to said U-shaped portion of said holder wherein said first retainer is positioned within said first lateral arm of said U-shaped portion of said holder proximate said open end of said first lateral arm of said U-shaped portion of said holder, said first retainer engaging the fastener wherein the fastener is retained in said first pair of grooves;

a second one of said pair of retainers being coupled to said U-shaped portion of said holder wherein said second retainer is positioned within said second lateral arm of said U-shaped portion of said holder proximate said open end of said second lateral arm of said U-shaped portion of said holder, said second retainer engaging the ferrule wherein the ferrule is retained in said pair of second grooves;

a fork movably coupled to said second lateral arm of said U-shaped portion of said holder proximate said leading edge of said open end of said second lateral arm of said U-shaped portion of said holder wherein said fork extends through a top side and a bottom side of said second lateral arm of said U-shaped portion of said holder, said fork being positionable in a retaining position wherein a pair of vertical arms of said fork extends downwardly through said bottom side of said second lateral arm of said U-shaped portion of said holder wherein said fork selectively retains the ferrule in said pair of second grooves, said fork being positionable in a releasing position wherein said pair of vertical arms of said fork are spaced upwardly away from said bottom side of said second lateral arm of said U-shaped portion of said holder wherein the ferrule is removable from said pair of second grooves; and a horizontal portion of said holder extending forwardly away from a bottom end of said vertical portion of said holder, said horizontal portion of said holder being positioned below the gutter wherein a top of said horizontal portion of said holder abuts a bottom side of the gutter wherein said horizontal portion of said holder is configured to support the gutter wherein the user drives the fastener into the roof edge wherein the fastener retains the gutter on the roof edge, a leading edge of an open end of said horizontal portion of said holder comprising a plurality of teeth, said plurality of teeth selectively engaging a facia on the roof edge wherein said holder is retained on the roof edge.

17. A gutter installation assembly for holding a gutter, a ferrule and a fastener proximate a roof edge, said assembly comprising:

a holder configured to be positioned proximate the roof edge, said holder comprising;

a vertical portion of said holder being configured to be gripped by a user;

a U-shaped portion of said holder coupled to said vertical portion of said holder wherein said U-shaped portion of said holder is configured to position the ferrule and the fastener proximate the roof edge;

a retainer coupled to said U-shaped portion of said holder wherein said retainer is configured to retain the fastener on said U-shaped portion of said holder;

a horizontal portion of said holder coupled to said vertical portion of said holder wherein said horizontal portion of said holder is configured to support the gutter when the user drives the fastener into the roof edge wherein the fastener retains the gutter on the roof edge; and a fork movably coupled to a second lateral arm of said U-shaped portion of said holder proximate a leading edge of an open end of said second lateral arm of said U-shaped portion of said holder wherein said fork extends through a top side and a bottom side of said second lateral arm of said U-shaped portion of said holder.

18. The assembly according to claim 17 further comprising said fork being positionable in a retaining position wherein a pair of vertical arms of said fork extends downwardly through said bottom side of said second lateral arm of said U-shaped portion of said holder wherein said fork selectively retains the ferrule in a pair of second grooves.

* * * * *